US007115301B2

(12) United States Patent
Sheu et al.

(10) Patent No.: US 7,115,301 B2
(45) Date of Patent: Oct. 3, 2006

(54) METHOD OF MARKING SOLID OR LIQUID SUBSTANCES WITH NUCLEIC ACID FOR ANTI-COUNTERFEITING AND AUTHENTICATION

(75) Inventors: Jue-Jei Sheu, Chungho (TW); Lin-Lin Chen, Chungho (TW); Emma Chen, Chungho (TW); Benjamin Liang, Chungho (TW)

(73) Assignee: Rixflex Holdings Limited, Tortola (VG)

( * ) Notice: Subject to any disclaimer, the term of this patent is extended or adjusted under 35 U.S.C. 154(b) by 332 days.

(21) Appl. No.: 10/748,412

(22) Filed: Dec. 29, 2003

(65) Prior Publication Data

US 2005/0008762 A1 Jan. 13, 2005

Related U.S. Application Data

(63) Continuation-in-part of application No. 09/832,048, filed on Apr. 9, 2001, now abandoned.

(51) Int. Cl.
*B05D 7/24* (2006.01)

(52) U.S. Cl. ..... 427/7; 427/256

(58) Field of Classification Search ..... 427/7, 427/256

See application file for complete search history.

(56) References Cited

U.S. PATENT DOCUMENTS 5,139,812 A * 8/1992 Lebacq ..... 427/7
5,498,283 A * 3/1996 Botros et al. ..... 106/31.43
5,599,578 A * 2/1997 Butland ..... 427/7
5,643,728 A 7/1997 Slater et al. ..... 435/6
6,261,809 B1 7/2001 Bertling et al. ..... 435/91.2
6,312,911 B1 11/2001 Bancroft et al. ..... 435/6

FOREIGN PATENT DOCUMENTS

EP 0 477 220 B1 4/1992
EP 0623658 A2 * 11/1994
WO WO 03/080931 A1 * 3/2003

* cited by examiner

*Primary Examiner*—Kirsten Jolley

(57) ABSTRACT

A method of marking a solid article or substance includes the steps of dissolving a water-insoluble medium in a first solvent to form a first mixture, mixing a nucleic acid solution with an intermediate solution to form a second mixture, mixing the second mixture with the first mixture to form a homogenous third mixture, marking the article or substance with the third mixture containing the nucleic acid; and drying the marked article or substance. Through the addition of an intermediate solution, the miscibility between the nucleic acid solution and the medium is increased and a homogenous solution is formed. For marking solid substances or articles, the water-insoluble medium containing known nucleic acid taggants is spread on the target solid substances or articles. For marking liquid, the target liquid is mixed with the water-insoluble media containing known nucleic acid taggants. As a result, the target liquid is labeled with nucleic acid.

17 Claims, 2 Drawing Sheets

METHOD OF MARKING SOLID OR LIQUID SUBSTANCES WITH NUCLEIC ACID FOR ANTI-COUNTERFEITING AND AUTHENTICATION

CROSS-REFERENCE TO RELATED APPLICATION

This application is a continuation-in-part of U.S. Ser. No. 09/832,048 filed on Apr. 9, 2001, now abandoned disclosure of which is incorporated herein by reference.

FIELD OF THE INVENTION

The present invention relates to a method of marking solid or liquid substances with nucleic acid for anti-counterfeiting and authentication, specifically to a method for marking solid or liquid substances with nucleic acid dissolved in a water insoluble medium through the addition of an intermediate solution.

DESCRIPTION OF THE RELATED ART

With the development of biotechnology, the application of biotechnology is not limited to the research work in laboratory anymore. In clinical field, the process of prevention, identification, and even the treatment of diseases are also combined with the advanced molecular biology techniques for optimal performance. Utilization of biotechnological methods to improve crops and the livestock is a routine practice. Furthermore, in combination with digital systems, individual biological features are converted into digital signals and utilized in areas such as switching on household appliances by the one's voice or the utilization of individual fingerprints or irises for security identification. The application of biotechnology to daily life matters is an inevitable trend for the future.

Nucleic acids, Ribonucleic acid (RNA) and Deoxyribonucleic acid (DNA) contain essential hereditary information. RNA and DNA are long polymers consisted of only 4 nucleotides, adenine (A), guanine (G), cytosine (C) and thymine (T) for DNA (or uracil (U) for RNA). The nucleotide structure can be broken down into 2 parts, the sugar-phosphate backbone and the base. All nucleotides share the sugar-phosphate backbone. The 3'-hydroxyl group on the ribose unit, reacts with the 5'-phosphate group on its neighbor to form a chain structure. A, T, G and C are capable of specific-pairing to form a double strand. Adenine forms two hydrogen bonds with thymine in DNA (uracil in RNA) and cytosine forms three hydrogen bonds with guanine. That is, T will bond to A only and G to C only.

Nucleic acids are susceptible to modifiers and degraders such as UV radiation and enzymes, however, with proper protection nucleic acids can be preserved over a long period of time. Fossil evidence shows that DNA is resistant to degradation over millions of years and is being used to learn more about ancient people and animals. Protected DNA can be stable and can be used as an identification marker. In addition, the ability to perform downstream reactions on nucleic acid molecules, such as PCR, is not affected by subjecting nucleic acid to extreme conditions of heat, which is the great advantage of nucleic acid for labeling.

Two identification methods are commonly used nowadays. One is the utilization of the unique features of the merchandise, and another way is to label or mark objects with specific taggants. Traditional taggants take advantage of physical or chemical properties of materials. For example, magnetic strips on checkbooks, laser holographs on credit cards, fluorescent inks on stocks, and heat-sensitive inks are widely seen. However, those labels can be easily mimicked and destroyed.

Owing to the advantage of specific binding, nucleic acid is used for anti-counterfeiting now. It is well known to persons skilled in the related art that nucleic acid, a highly water-soluble molecule, easily dissolves in water-soluble solution, such as TE buffer. However, it seems impracticable to dissolve nucleic acid with water-insoluble solvents or medium. In EP 0 477 220 B1, DNA is dissolved in distilled water and spread on the target. However, DNA taggants dissolved in water are easily removed after drying and the labeling is not lasting. In addition, detergents such as Span®80 are needed for mixing the DNA taggants with the non-polar liquids or oils to be labeled in EP 0 477 220 B1. However, this type of DNA taggants cannot adhere on the objects for a long period of time and may lose the anti-counterfeiting function easily.

SUMMARY OF THE INVENTION

Accordingly, the present invention is directed to a method of marking solid or liquid substance with nucleic acid for anti-counterfeiting and authentication that substantially obviates one or more of the problems due to limitations and disadvantages of the related art.

A primary object of the present invention is to provide a method of marking solid or liquid substance with nucleic acid for anti-counterfeiting and authentication, in which nucleic acids are dissolved in a water-insoluble medium to form a homogenous solution.

Another object of the present invention is to provide a method of marking solid or liquid substance with nucleic acid for anti-counterfeiting and authentication in which the nucleic acid taggants are specific and not easily mimicked.

Still an object of the present invention is to provide a method of marking solid or liquid substance with nucleic acid for anti-counterfeiting and authentication, in which the nucleic acid taggants are not easily damaged and erased in the water-insoluble medium.

In order to achieve the foregoing objects, a method of marking solid substance with nucleic acid for anti-counterfeiting and authentication is provided. A water-insoluble medium is dissolved in a first solvent to form the first mixture, the medium/solvent mixture. A nucleic acid solution is mixed with an intermediate solution to form a homogenous second mixture. The second mixture is mixed with the first mixture and forms a homogenous third mixture. The intermediate solution increases the miscibility between the nucleic acid solution and the water-insoluble medium/solvent solution. The medium is an inert medium and is not deteriorative to the nucleic acid and substances.

In the case of making a water insoluble liquid with nucleic acid for anti-counterfeiting and authentication, a similar method to the above mentioned but with little difference is provided. A nucleic acid is dissolved in an aqueous solution to form a first mixture. The first mixture is mixed with an intermediate solution to form a second mixture. The second mixture is mixed with a water insoluble solvent to form a homogenous third mixture. The intermediate solution increases the miscibility between the nucleic acid solution and the water insoluble solvent.

The solubility of a solute in a given solvent is known as a function of the polarity of the solvent. Solvents may be considered polar, semi-polar or non-polar. Polar solvents will dissolve ionic and other polar solutes (i.e. those with an asymmetric charge distribution [like dissolves like]), whereas, non-polar solvents will dissolve non-polar molecules. Semi-polar solvents, for example, alcohols and acetones, may induce a certain degree of polarity in non-polar molecules and may thus act to improve the miscibility of polar and non-polar liquids. The dielectric constant (e) of a compound is an index of its polarity. Solvents are usually classified according to their dielectric constants as polar (e>50), semi-polar (e=20–50), or non-polar (e=1–20). In the present invention, nucleic acid is polar molecules while the water-insoluble medium dissolved in the first solvent is a non-polar one. An intermediate solution of semi-polarity is used to increase the miscibility between the nucleic acid and the medium/solvent mixture.

The term "nucleic acid" used in the present invention comprises both deoxyribonucleic acid (DNA) and ribonucleic acid (RNA). The nucleic acid used is selected from a group consisting of natural and synthetic nucleic acid. The term "natural nucleic acid" as used herein means nucleic acid prepared from all prokaryotes, viruses, fungi, eukaryotes, such as animals, plants, and other organisms. The term "synthetic nucleic acid" includes synthetic vectors and synthetic nucleic acid fragments.

Nucleic acid is dissolved in a water-soluble solution to form the nucleic acid solution. The water-soluble solution may be water, TE buffer or other buffers.

The medium is an inert medium and is not deteriorative to nucleic acid and substance to be labeled. The water-insoluble medium comprises a polymeric substance, for example, polypropylene (PP), polymethyl methacrylate (PMMA), polycarbonate (PC) and polystyrene (PS). In the following preferred embodiments, the water-insoluble medium used is polystyrene (PS) and polystyrene (PC).

The first solvent used herein to dissolve the water-insoluble medium comprises an organic solvent. As used herein, the first solvent is selected from a group consisting of chloroform, dichloromethane and benzole solvent, such as xylene or toluene. However, other organic solvent known in the related art may also be used.

The intermediate solution is used to increase the miscibility between the nucleic acid and the medium/solvent mixture. The intermediate solution used herein preferably comprises a semi-polar solvent of which the dielectric constant is preferably between 20 and 50. The intermediate solution is selected from a group consisting of methanol, ethanol, acetone, glycerol and their mixture.

The above-mentioned solid substances or articles include antiques, paintings, jewelry, identification cards, credit cards, magnetic strip cards, sports collectibles, souvenirs and other solid collectibles. The foregoing liquid includes inks, paints, dyes, dyestuffs, color wash, pigments, seals, glues, cosmetics and others. After labeling with nucleic acid, the objects have anti-counterfeiting function.

For marking solid substances or articles, the water-insoluble medium containing known nucleic acid taggants is spread on the target solid substances or articles. After drying, the nucleic acid taggants protected by the water-insoluble medium adhere on the surface of the object.

For marking liquid, the target liquid is mixed with the water-insoluble media containing known nucleic acid taggants. As a result, the target liquid is labeled with nucleic acid.

Also, products with nucleic acid labeled are manufactured by means of materials of water-insoluble medium containing nucleic acid taggants.

Both solid and liquid are labeled in the present invention. For authentication, a small portion of the labeled substances is dissolved with an organic solvent and then mixed with a buffer of high nucleic acid solubility. The nucleic acid taggants dissolved in the buffer are separated and collected from the solvent by centrifugation. Finally, the collected nucleic acid taggants are amplified by Polymerase Chain Reaction (PCR) and examined by gel electrophoresis.

Since the sequence of the nucleic acid taggant is specific, the original nucleic acid will be amplified only with the primers of specific sequences. In addition, the concentration of the nucleic acid in the medium is so low that the sequence of the nucleic acid taggant is hard to be decoded. The purpose of anti-counterfeiting is then achieved.

For more detailed information regarding advantages and features of the present invention, examples of preferred embodiments will be described below with reference to the drawings. Both the foregoing general description and the following detailed description are exemplary and explanatory and are intended to provide further explanation of the invention as claimed.

BRIEF DESCRIPTION OF THE DRAWINGS

The related drawing in connection with the detailed description of the present invention to be made later is described briefly as follows, in which.

DETAILED DESCRIPTION OF THE PREFERRED EMBODIMENT

Several preferred embodiments of the present invention are described in detail below with reference to the drawings annexed. It should be understood that these examples are intended to be illustrative only and that the present invention is not limited to the conditions or materials recited therein.

EXAMPLE 1

Mixing DNA with Polystyrene (PS)

5 μg of prepared DNA is dissolved in 100 μl of distilled water to form a DNA solution. 5 g of PS is dissolved in 50 ml chloroform to a concentration of 10% (w/v). 10 μl of 95% ethanol and acetone, as intermediate solution, are added respectively to the DNA solution. Then, DNA solution containing the intermediate solution is mixed homogeneously with the PS/chloroform solution through vigorous vortex. Through such intermediate process, water-soluble DNA solution and water-insoluble medium of PS/chloroform solution are mixed completely to form a homogenous medium containing desired DNA.

EXAMPLE 2

Figure 1:
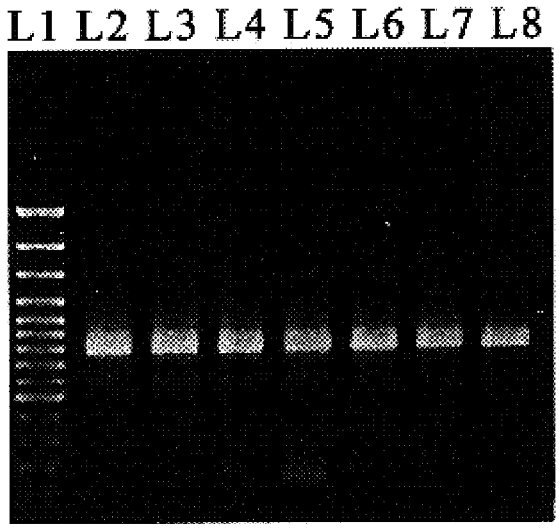
FIG. 1. shows 800 base pair (bp) DNA taggants which are recovered from a small portion of a plastic film, amplified by PCR and stained with ethidium bromide (EtBr) after gel electrophoresis.

Marking Plastic Films with Synthesized DNA Taggants for Anti-counterfeiting and Authentication Synthesized DNA of 800 bp is dissolved in 95% ethanol and acetone in equal amount and mixed with polycarbonate/chloroform solution as mentioned above. A plastic film is spread with the homogenous medium containing desired DNA and air-dried. After drying, the plastic film is placed in the dark, or at 4° C. Alternatively, the plastic film is exposed to sunlight for one day before recovery. For recovery, a small piece of the plastic film is dissolved with chloroform. TE buffer is added and mixed well with the dissolved plastic film in chloroform and then centrifuged. The supernatants are collected and served as the templates for PCR. PCR products are then analyzed by electrophoresis and stained with EtBr. As indicated in FIG. 1, samples labeled with DNA taggants show a clear band of 800 bp on the gel. From left to right, L1 is the standard 100 bp DNA ladder. L2 is PCR products amplified from the sample retrieved from the dark. L3, L4, and L5 are PCR products amplified from samples exposed under sunlight. L6, L7, and L8 are PCR products amplified from samples of 4° C. treatment. Results show that DNA taggants of 800 bp can be recovered from the plastic films with three different treatments and verified through electrophoresis after amplification of PCR.

EXAMPLE 3

Figure 2:
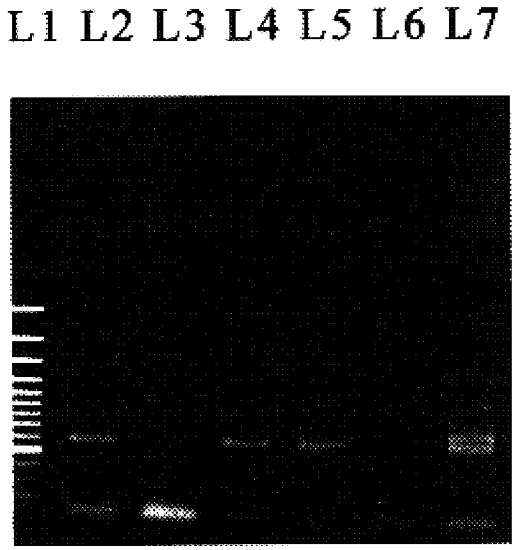
FIG. 2. shows 600 bp human WBC DNA taggants recovered from a small portion of a plastic film, amplified by PCR and stained with ethidium bromide (EtBr) after gel electrophoresis.

Marking Plastic Films with Human White Blood Cell (WBC) DNA Taggants for Anti-Counterfeiting and Authentication The extracted Human WBC DNA is dissolved in 95% ethanol and equal amount of acetone and then mixed with polycarbonate/chloroform solution as mentioned above. The plastic film is spread with the homogenous medium containing desired DNA and air-dried. After drying, the plastic film is placed in the dark, or at 4° C. Alternatively, the plastic film is exposed to sunlight for one day before recovery. For recovery, a small piece of the plastic film is dissolved with chloroform. TE buffer is added and mixed well with the dissolved plastic film in chloroform and then centrifuged. The supernatants are collected and served as the templates for PCR. PCR products are then analyzed by electrophoresis and stained with EtBr. As indicated in FIG. 2, samples labeled with Human WBC DNA taggants show a clear band of 600 bp on the gel. From left to right, L1 is the standard 100 bp DNA ladder. L2 and L3 are PCR products amplified from the template of 1 μl of the supernatant. L4 and L5 are PCR products amplified from the template of 2 μl of the supernatant. L6 is the PCR product amplified without DNA template (the negative control). L7 is the PCR product amplified with human WBC DNA (positive control). Results show that human WBC DNA can be recovered from the plastic films with three different treatments and verified through electrophoresis after amplification of PCR.

EXAMPLE 4

Figure 3:
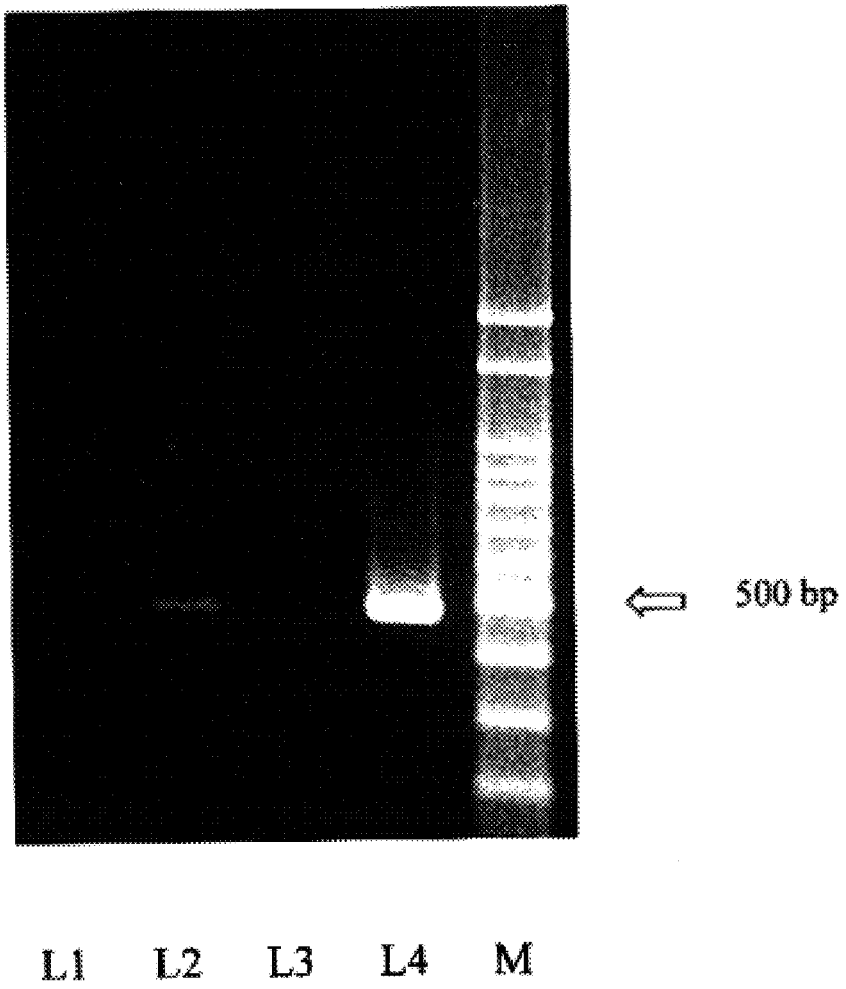
FIG. 3. shows 500 bp *E. coli* plasmid DNA taggants recovered from paraffin oil, amplified by PCR and stained with ethidium bromide (EtBr) after gel electrophoresis.

Marking Paraffin Oil with *E. coli* Plasmid DNA Taggants for Anti-counterfeiting and Authentication Four treatments are described as follows. In L1: 1 μl of *E. coli* plasmid DNA (100 pg/μl) is dissolved in 5 μl water and then mixed with paraffin oil directly. L1 is a comparison treatment. In L2: 1 μl of *E. coli* plasmid DNA (100 pg/μl) is added in 50 μl polycarbonate first and then with paraffin oil. L3 is the negative control, which contains only paraffin oil and polycarbonate/chloroform solution. L4 is the positive control, which contains only *E. coli* plasmid DNA. L1~L4 are centrifuged at 6000 g for 1 minute. 10 μl of the supernant is used for DNA extraction by phenol-chloroform. The extracted DNA is dissolved in 30 μl water. 1 μl of the extracted DNA solution serving as template is used for PCR reaction. The PCR products are analyzed by electrophoresis. As shown in FIG. 3, it is clear that *E. coli* plasmid DNA of L1 is not recovered before the addition of polycarbonate/chloroform solution. In L2: DNA is mixed with paraffin oil and recovered through the addition of polycarbonate/chloroform solution. M is the standard 100 bp DNA ladder.

We claim:

1. A method of marking a solid article or substance, comprising the following steps:

dissolving a water-insoluble medium in a first solvent to form a first mixture;

mixing a nucleic acid solution with an intermediate solution to form a second mixture, the intermediate solution being a semi-polar solvent;

mixing the second mixture with the first mixture to form a homogenous third mixture;

marking the article or substance with the third mixture; and drying the marked article or substance;

wherein the water-insoluble medium is an inert medium not deteriorative to the article or substance, and the intermediate solution increases the miscibility between the first mixture and the second mixture.

2. The method as claimed in claim 1, wherein the first solvent is a non-polar solvent.

3. The method as claimed in claim 2, wherein the non-polar solvent is selected from a group consisting of chloroform, dichloromethane, xylene and toluene.

4. The method as claimed in claim 1, wherein the intermediate solution is selected from a group consisting of methanol, ethanol, acetone, glycerol and their mixture.

5. The method as claimed in claim 1, wherein the nucleic acid in the nucleic acid solution is selected from a group consisting of a natural and a synthetic nucleic acid.

6. The method as claimed in claim 5, wherein the synthetic nucleic acid is a synthetic vector.

7. The method as claimed in claim 5, wherein the synthetic nucleic acid is a nucleic acid fragment.

8. A method of marking a solid article or substance, comprising the following steps:

dissolving a water-insoluble medium in a first solvent to form a first mixture, the water-insoluble medium being a polymeric substance;

mixing a nucleic acid solution with an intermediate solution to form a second mixture;

mixing the second mixture with the first mixture to form a homogenous third mixture;

marking the article or substance with the third mixture; and drying the marked article or substance;

wherein the water-insoluble medium is an inert medium not deteriorative to the article or substance, and the intermediate solution increases the miscibility between the first mixture and the second mixture.

9. The method as claimed in claim 8, wherein the polymeric substance is selected from a group consisting of polycarbonate (PC), polymethyl methacrylate (PMMA), polystyrene (PS), and polypropylene (PP).

10. A method of marking a water insoluble liquid, comprising the following steps:

dissolving a nucleic acid in a aqueous solution to form a first mixture;

mixing the first mixture with an intermediate solution to form a second mixture;

mixing the second mixture with a water insoluble solvent to form a homogenous third mixture; and mixing and marking the liquid with the third mixture;

wherein the intermediate solution increases the miscibility between the second mixture and the water insoluble solvent.

11. The method as claimed in claim 10, wherein the water insoluble solvent is a non-polar solvent.

12. The method as claimed in claim 11, wherein the non-polar solvent is selected from a group consisting of chloroform, dichloromethane, xylene and toluene.

13. The method as claimed in claim 10, wherein the intermediate solution is a semi-polar solvent.

14. The method as claimed in claim 13, wherein the intermediate solution is selected from a group consisting of methanol, ethanol, acetone, glycerol and their mixture.

15. The method as claimed in claim 10, wherein the nucleic acid is selected from a group consisting of a natural and a synthetic nucleic acid.

16. The method as claimed in claim 15, wherein the synthetic nucleic acid comprises a synthetic vector.

17. The method as claimed in claim 15, wherein the synthetic nucleic acid comprises a nucleic acid fragment.

* * * * *